United States Patent [19]

Yuenian

[11] Patent Number: 4,697,302

[45] Date of Patent: Oct. 6, 1987

[54] SPRING OPERATED AUTOMATIC DOOR AND WINDOW CLOSING HINGE

[76] Inventor: Sun Yuenian, P.O. Box 5106-6, Hai Dain District, Beijing

[21] Appl. No.: 846,746

[22] Filed: Apr. 1, 1986

[30] Foreign Application Priority Data

Apr. 1, 1985 [CN] China ..... 85200341

[51] Int. Cl.[4] ..... E05F 3/14

[52] U.S. Cl. ..... 16/52; 16/55; 16/58; 16/82; 16/DIG. 9

[58] Field of Search ..... 16/49, 50, 52, 54, 55, 16/58, 66, 72, 82, 84, 275, 276, 297, 307, DIG. 9, DIG. 10, DIG. 17

[56] References Cited

U.S. PATENT DOCUMENTS

| | | | |
|---|---|---|---|
| 2,200,418 | 5/1940 | Dudley | 16/276 X |
| 2,209,553 | 7/1940 | Bannenberg | 16/62 |
| 2,538,679 | 1/1951 | Foltis | 16/68 |
| 4,100,646 | 7/1978 | Schubeis | 16/54 |
| 4,190,925 | 3/1980 | Koivusalo | 16/54 |
| 4,358,870 | 11/1982 | Hong | 16/58 X |
| 4,485,522 | 12/1984 | Chen | 16/58 X |

FOREIGN PATENT DOCUMENTS

| | | | |
|---|---|---|---|
| 121766 | 3/1931 | Austria | 16/54 |
| 55-9933 | 1/1980 | Japan . | |
| 57-71977 | 5/1982 | Japan . | |
| 22257 | 10/1903 | United Kingdom | 16/276 |

*Primary Examiner*—Fred Silverberg

*Attorney, Agent, or Firm*—Hill, Van Santen, Steadman & Simpson

[57] ABSTRACT

An automatic door/window closing device has a center shaft provided with V-shaped spiral channels to a base such as its surface and secured to a base such as the ground, a floating piston which forms a screw pair with the shaft by engagement of steel balls in the spiral channels, a housing with a flange which is secured to the door or window, a spring for providing the force to automatically close the door, and a cover. This device has a simple structure and is very light and which permits a door to be opened in both directions. After opening, the door will automatically close, and it can be also be damped for slowly closing the door. The door will rest when it opens to 90°.

5 Claims, 4 Drawing Figures

SPRING OPERATED AUTOMATIC DOOR AND WINDOW CLOSING HINGE

BACKGROUND OF THE INVENTION

The present invention relates to a device for automatically closing a door or window.

Conventional door closing devices have a spring hinge with one or two sleeves. Other types of automatic door closing devices have been developed, such as a floor hinge and a hydraulic damped hinge. However, they are complicated in structure and heavy in weight (for example, a floor hinge weighs 9–10 kilogrammes), and therefore are expensive.

The object of the present invention is to provide a new automatic door/window closing device which has a simple structure and light weight.

This object is accomplished according to the invention in a device having a center shaft provided with spiral channels on its surface and secured on the ground, steel balls rolling in the spiral channels, a floating piston which forms a screw pair with the center shaft by means of said steel balls, a housing with a flange which is to be secured to the door, a spring for supplying the force to automatically close the door, and a cover.

The spiral channel has a V-shaped section and two horizontal sections in both ends of the V-shaped section. When said steel balls are located in the V-shaped section of said channels, i.e. the door is opened to less than 90° in either direction, the door will automatically close due to the force produced by said spring. When the door is not required to be closed, then the door is opened to 90°, the steel balls are located in the horizontal sections of said channels and self-locked, and the door stops moving for loss of the automatic closing function. When a period of time later, the opened door is to be closed, it only needs to be slightly pushed thereby causing the balls to slide out of the horizontal sections and into the V-shaped sections of said channels, so that the automatic door closing function returns.

Further features and advantages of the invention will become evident from the following claims, description and accomponying drawings.

DESCRIPTION OF THE DRAWINGS

Hereinafter, the preferred embodiments of the invention are described in detail with reference to the drawings, wherein.

DESCRIPTION OF THE PREFERRED EMBODIMENTS

Figure 2:
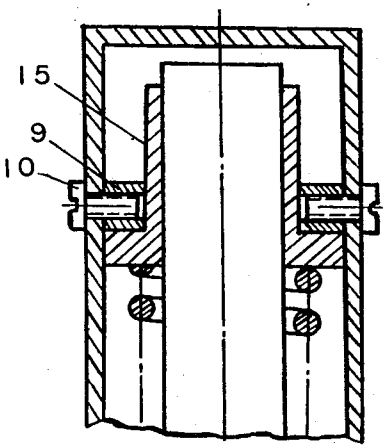
FIG. 2 is a partial sectional view taken along the line II—II in FIG. 1.
Figure 1:
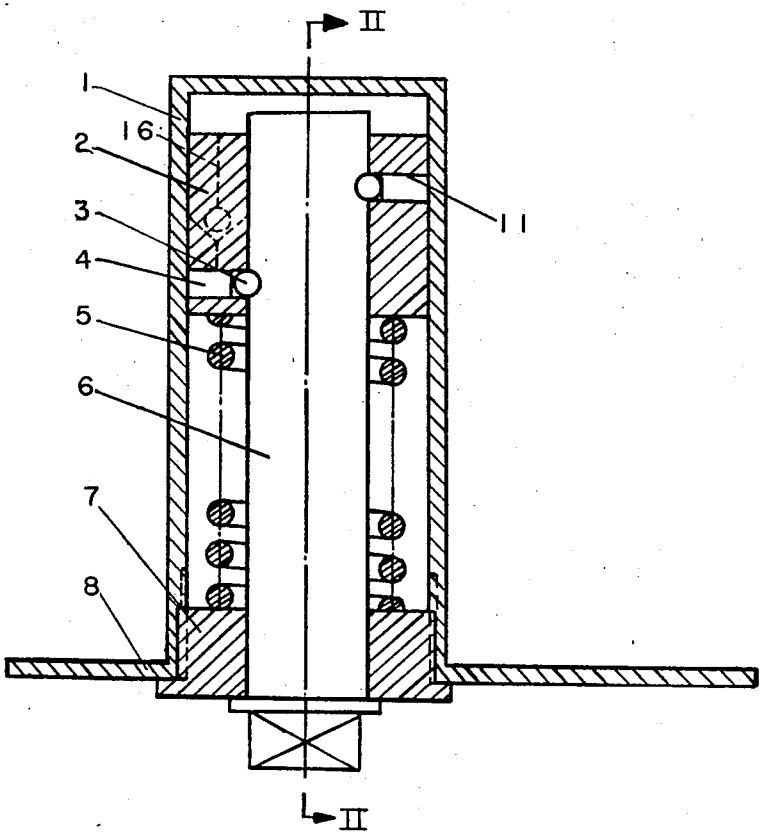
FIG. 1 is a sectional view of a preferred embodiments of the device according to the invention.
Figure 4:
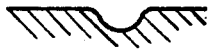
FIG. 4 is a cross-sectional view taken along the line IV—IV in the FIG. 3.
Figure 3:
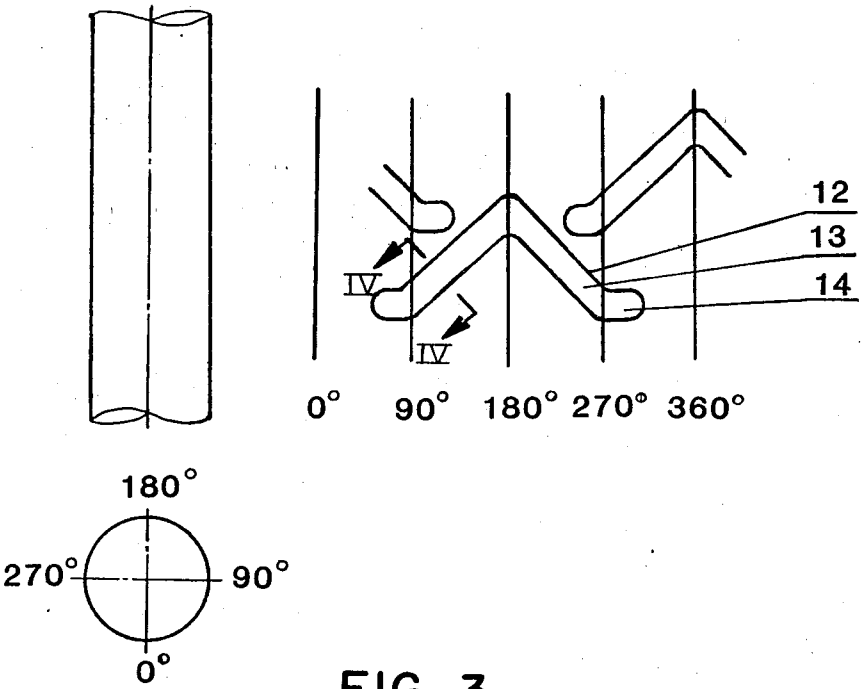
FIG. 3 is an "unrolled" view of the channels of the center shaft.

The device in accordance with the invention shown in FIG. 1 and FIG. 2 has a center shaft 6 secured on the ground, a housing 1, a floating piston 2, a spring 5, steel balls 3 and a cover 7. The housing 1 is secured to the door through a flange 8. The center shaft 6 has two spiral channels 12 (FIG. 3) on its surface with the steel balls 3 rolling therein, and each of the spiral channels has a V-shaped section 13 and two horizontal sections 14 in both ends of said V-shaped section. The floating piston 2 forms a screw-and-thread-combination with the spiral channels by means of the two steel balls 3. The steel balls are restricted by two holes 11 in the floating piston 2 and two pins 4 therein. The floating piston 2 has two flat surfaces 15 which slidably match two sliding pieces 9 which are symmetrically fixed to the housing 1 by two bolts 10, so as to convert the rotational movement of the housing 1 along with the door into the up-and-down linear movement of the floating piston 2, and thereby to compress spring 5. After the force of pushing or drawing the door disappears, the floating piston 2 is pushed by the compressed spring 5 to return to its original position thereby rotating the housing 1, and the door is closed. When the door is not required to be closed, i.e. the door is opened to about 90°, the steel balls 3 are positioned in the horizontal sections 14 of the spiral channels 12, and the door stops moving for loss of the automatic closing function. If it is in need of being closed, it is only necessary to push the door slightly, then the automatic closing function will return.

According to different door weights and the desired closing speed of the door, the spring 5 can be designed to have a selected spring force. It is also possible to use washers on the center shaft 6 and the cover 7 for adjusting the preload of the spring 5, such that the desired closing speed can be obtained.

In order to further improve the performance of the present device, it can be designed to have a damper system. This can easily be done by providing hydraulic oil inside the housing 1 and improving the sealing thereof. The floating piston 2 divides the housing 1 into two oil chambers, namely an upper chamber and a lower chamber, and two chambers communicate with each other by a one-way valve or damper 16 in the piston 2. When said floating piston 2 moves downward, i.e. the door is being opened, the valve 16 opens completely and provides no resistance for oil flow. When the force of pushing the door disappears, the floating piston 2 returns to its original position under the force produced by the compressed spring 5, the valve 16 closes, and the hydraulic oil in the upper chamber slowly flows into the lower chamber to carry out the damping function and the impact of closing the door is therefore reduced.

The device according to the present invention is very compact in construction, it can be directly mounted inside the wooden door or the hollow space of the metal door. It can also be used in the windows and this advantage will facilitate cleaning of the windows of high buildings.

I claim as my invention:

1. An automatic closing device for a door or window comprising a center shaft provided with two spiral channels on its surface and secured on the ground, each spiral channel having a V-shaped section, each V-shaped section having two horizontal sections respectively disposed at opposite ends thereof, steel balls rolling in said spiral channels, a floating piston which forms a screw-and-thread pair with said center shaft by means of said steel balls, said floating piston having two flat surfaces thereof, a housing with a flange adapted to be secured to the door or window, two sliding pieces symmetrically fixed to an upper portion of said housing disposed adjacent said flat surfaces of said floating piston for converting rotational movement of said housing into linear movement of said floating piston or vice versa, and a spring normally urging said piston into said housing.

2. The automatic door/window closing device according to claim 1, further comprising hydraulic fluid in said housing and a one-way valve in said floating piston disposed for slowing the closing speed of said door or window.

3. The device of claim 1, wherein said spiral channels have a shape selected such that pivoting of said door or window is inhibited by restraining rolling of said steel balls therein when said door or window is at a selected angle relative to a fixed object.

4. The device of claim 3 wherein said angle is 90°.

5. The device of claim 1, wherein said housing is closed and said piston divides said housing into an upper chamber and a lower chamber, and further comprising hydraulic fluid in said upper and lower chambers and a one-way valve in said piston permitting flow of said hydraulic fluid through said piston as said piston is moved against said bias means and blocking flow of said hydraulic fluid as said piston is moved by said bias means thereby damping movement of said piston and controlling the speed of closing of said door or window.

* * * * *